US007811114B2

(12) United States Patent
Gabrielsson

(10) Patent No.: US 7,811,114 B2
(45) Date of Patent: Oct. 12, 2010

(54) CONNECTOR WITH IMPROVED LATCHING MECHANISM

(75) Inventor: Per Georg Gabrielsson, Hässelby (SE)

(73) Assignee: FCI, Versailles (FR)

( * ) Notice: Subject to any disclaimer, the term of this patent is extended or adjusted under 35 U.S.C. 154(b) by 189 days.

(21) Appl. No.: 12/085,625

(22) PCT Filed: Nov. 28, 2005

(86) PCT No.: PCT/EP2005/014194

§ 371 (c)(1),
(2), (4) Date: May 27, 2008

(87) PCT Pub. No.: WO2007/059798

PCT Pub. Date: May 31, 2007

(65) Prior Publication Data

US 2009/0258525 A1 Oct. 15, 2009

(51) Int. Cl.
*H01R 13/627* (2006.01)

(52) U.S. Cl. ..... 439/350

(58) Field of Classification Search ..... 439/350, 439/352, 357, 483

See application file for complete search history.

(56) References Cited

U.S. PATENT DOCUMENTS

| | | | | |
|---|---|---|---|---|
| 5,564,939 | A | 10/1996 | Maitani et al. | 439/352 |
| 5,954,531 | A | 9/1999 | Jennings et al. | 439/352 |
| 2001/0021602 | A1 * | 9/2001 | Zanten | 439/358 |
| 2002/0182923 | A1 * | 12/2002 | Li et al. | 439/357 |

FOREIGN PATENT DOCUMENTS

| | | |
|---|---|---|
| EP | 1 115 178 | 7/2001 |

* cited by examiner

*Primary Examiner*—Alexander Gilman
(74) *Attorney, Agent, or Firm*—Harrington & Smith

(57) ABSTRACT

The invention relates to a connector including a connector housing and a latch including a first beam and a second beam, which first and second beam are connected with each other. The first beam includes a first locking structure and the second beam includes a second locking structure capable of locking said connector onto a counterpart in a locking position of said first and second locking structure. The first beam includes a force application element and the second beam and the connector housing are arranged to interact with each other in order to move the second locking structure from said locking position to a release position on application; of a force on said force application element. The invention further relates to a latch and a method of releasing a cable connector from a board connector.

11 Claims, 6 Drawing Sheets

CONNECTOR WITH IMPROVED LATCHING MECHANISM

FIELD OF THE INVENTION

The invention relates to the field of connectors for signal transfer or providing power. More specifically, the invention relates to connectors for signal transfer or providing power comprising a latch to lock said connectors on and release said connectors from a counterpart, such as a mating connector or a panel.

BACKGROUND OF THE INVENTION

In order to prevent undesired removal of a connector fitted with a mating connector, a connector normally has engagement portions which engage with other engagement portions of the mating connector after the connector is fitted with the mating connector. Typical engagement portions are locking structures such as locking hooks, while ones of a mating connector are slits or grooves with which the locking hooks can engage. Conventionally, a connector with locking structures comprises a control mechanism for controlling the above-mentioned engagement, especially, the positions of the locking structures. The conventional control mechanism includes two buttons provided on opposite sides of the connector in a lateral direction. When the buttons are pinched and are pushed inwardly by two fingers of a user, the locking structures do not work for a mating connector so that the engagement is released if it is established before or that the connector can be easily fitted with the mating connector when being connected to the mating connector.

However, in some situations insufficient space is available to provide buttons on opposite sides of the connector and/or access space to operate these buttons is limited. In such a situation, it is preferred to have a connector that can engage the connector with or to release the connector from a mating connector or other counterpart by operating only a single button.

On the other hand, multiple locking structures may be desired to establish optimal engagement between the connector and the mating connector or other counterpart.

SUMMARY OF THE INVENTION

It is an object of the invention to provide a connector with improved latching capabilities.

It is a further object of the invention to provide a connector that can be connected or released in situations of limited space for providing an operating button and/or accessing an operating button.

It is a still further object of the invention to provide a connector comprising a latch that can be operated by a single operating button, while the latch comprises multiple locking structures.

The invention provides a connector comprising a connector housing and a latch comprising a first beam and a second beam, which first and second beam are connected with each other. The first beam comprises a first locking structure and the second beam comprises a second locking structure capable of locking said connector onto a counterpart in a locking position of said first and second locking structure. The first beam comprises a force application element and the second beam and the connector housing are arranged to interact with each other in order to move said second locking structure from said locking position to a release position on application of a force on said force application element.

By structuring the latch and connector housing such that a force applied to the first beam can be suitably transferred to the second beam such that this second beam moves in the appropriate direction for either locking the connector onto or releasing the connector from a counterpart, the first and second beam can be provided with locking structures that can be moved by operating only a single button coupled to the first beam. Consequently, a connector is provided that only requires little (handling) space to lock the connector onto or release the connector from a counterpart, while the latch responsible for locking has at least two locking structures.

It should be appreciated that the connector may either be an electrical or an optical connector and may be either a cable connector or a board connector.

The latch preferably is a monolithic latch.

Further, it should be appreciated that the latch may comprise a force application element for each beam and that application of a force on only one of said force application elements triggers movement of both said first and second locking structure. Such an embodiment is defined in claim 2.

The embodiment of the invention as defined in claim 3 is advantageous in that the rotation mechanism of the latch provides an efficient way of transferring the force applied on the first beam to the second beam (or vice versa) in order to release the second locking structure.

The embodiment of the invention as defined in claim 4 provides the advantage that the outwardly extending locking hooks lock the connector onto the counterpart when no force is applied on the force application element and the resilient nature of the latch is used to advantage when a force is applied to release the locking hooks from the counterpart. Moreover, the embodiment of claim 4 provides space between the beams of the latch for other components of the connector, such as keying means.

The embodiment of the invention as defined in claim 5 provides the advantage that the movement of the latch or portions thereof can be controlled during application of a force on the force application element of the first beam.

The embodiment of the invention as defined in claim 6 provides a suitable and simple way to operate the latch. It should however be appreciated that one or more intermediate elements may be present between the force application element of the latch and the user to operate the latch.

The embodiment of the invention of claim 7 defines an embodiment wherein only limited space is available to provide or handle a release button and wherein, accordingly, the invention can be advantageously applied.

The invention further provides a cable connector comprising a connector housing and a latch comprising a first beam and a second beam, which first and second beam are connected with each other via a connection element. The first beam comprises a first locking hook and the second beam comprises a second locking hook capable of locking said connector onto a counterpart in a locking position of said first and second locking hook. The first locking hook and second locking hook extend in a direction away from each other. The first beam comprises a force application element and the connector housing comprises a ridge such that, on application of a force on said force application element, said latch rotates around said ridge by interaction with said second beam and said second locking hook moves from said locking position to a release position.

By providing a ridge in the connector housing such that a force applied to the first beam can be suitably transferred to the second beam such that this second beam moves in the appropriate direction for either locking or releasing the connector from a counterpart, the first and second beam can be provided with locking hooks that can be moved by operating only a single button coupled to only the first beam. Consequently, a connector is provided that only requires little (handling) space to lock the connector onto or release the connector from a counterpart, while the latch responsible for locking has at least two locking hooks.

The invention also relates to a latch comprising a first beam and a second beam connected by a connection element, wherein said first beam and said second beam respectively comprise a first locking hook and a second locking hook extending away from each other and said first beam comprises a force application button for operating said latch.

Such a latch can be applied advantageously in a connector as described above.

The embodiment of the invention as defined in claim 10 provides the advantage that movement of the latch or portions thereof can be controlled during application of a force on the force application button.

Finally, the invention also relates to a method for releasing a cable connector from a board connector. The cable connector comprises a connector housing and a latch comprising a first beam and a second beam, which first and second beam are connected with each other via a connection element. The first beam comprises a first locking structure and the second beam comprises a second locking structure capable of locking said connector onto said board connector in a locking position of said first and second locking structure. The first beam comprises a force application element and said second beam and said housing are arranged to interact with each other in order to move said second locking structure. The method comprises the step of applying a force on said force application element of said first beam to release said first and second locking structure from said board connector.

The invention will be further illustrated with reference to the attached drawings, which schematically show a preferred embodiment according to the invention. It will be understood that the invention is not in any way restricted to this specific and preferred embodiment.

DETAILED DESCRIPTION OF THE DRAWINGS

Figure 1B:
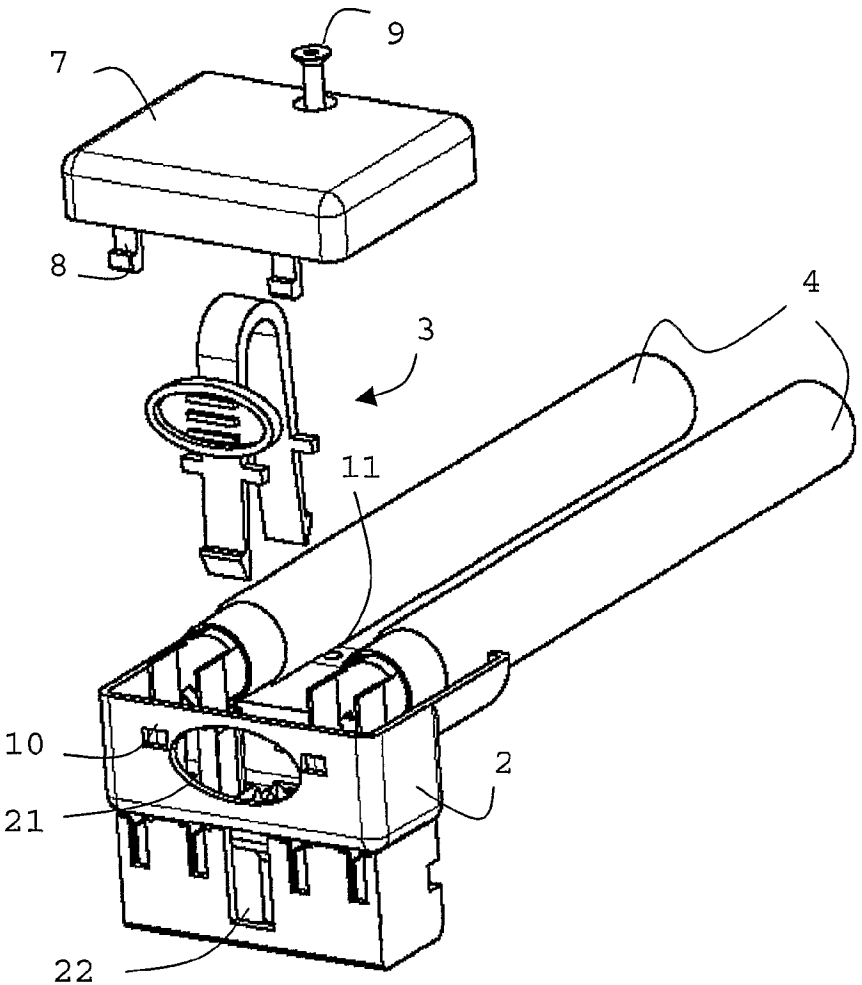
FIGS. 1A and 1B illustrate a cable connector in respectively an assembled state and in exploded view according to an embodiment of the invention.
Figure 1A:
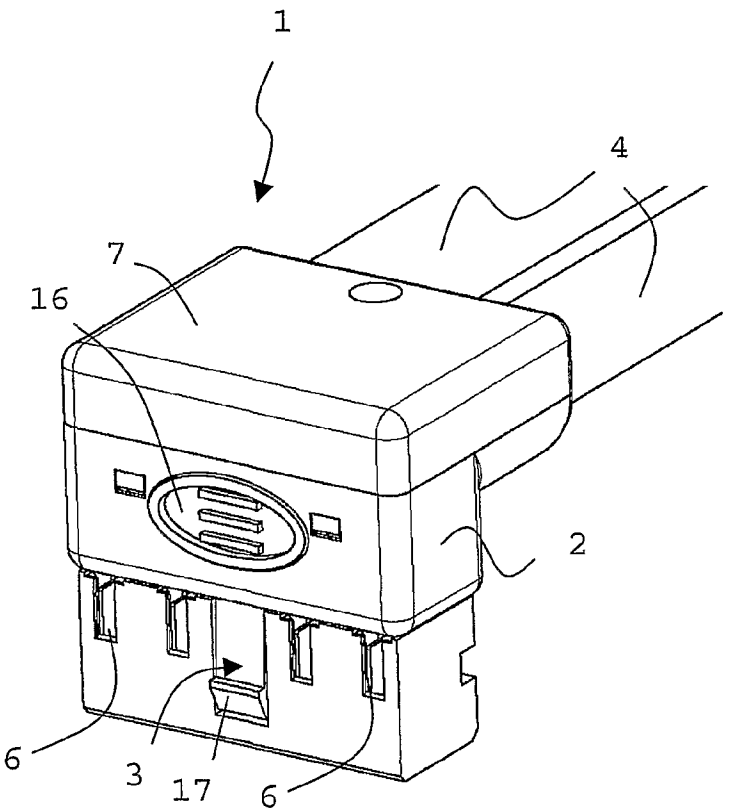
Figure 3:
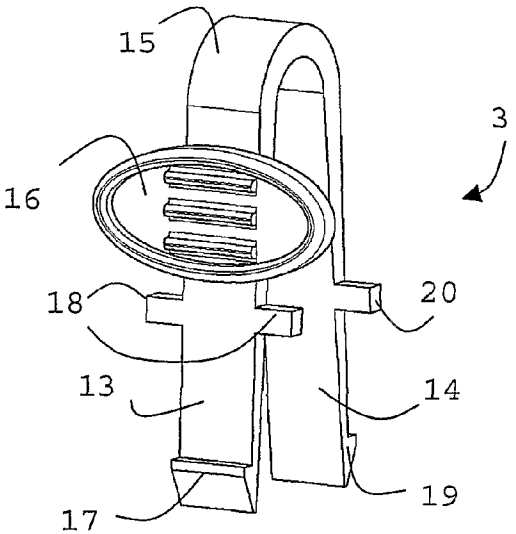
FIG. 3 depicts a latch of the cable connector of FIG. 1A according to an embodiment of the invention.
Figure 2:
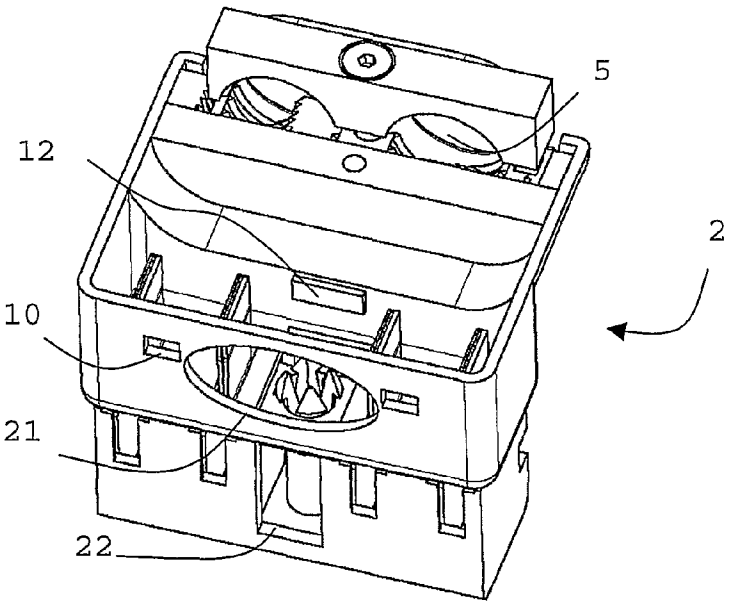
FIG. 2 depicts a portion of a housing of the cable connector of FIG. 1A.

FIGS. 1A and 1B show a cable connector 1 according to an embodiment of the invention. FIGS. 2 and 3 respectively depict a connector housing 2 and a latch 3 of the connector 1.

The cable connector 1 has two cables 4, entering the connector housing 2 via openings 5, with wires (not shown) connected to a series of contacts 6 provided in a connector housing 2. The openings 5 and contacts 6 are arranged such that the longitudinal axis of the openings 5 in which direction the cables 4 extend are arranged substantially perpendicular to the insertion direction for the contacts 6.

The connector housing 2 is completed by a cover 7 with latches 8 and a screw 9 fitting respectively into openings 10 and a threaded hole 11 of the connector housing 2.

An interaction structure 12 is provided on a wall of the connector housing 2. In the present embodiment, this interaction structure 12 is a ridge.

The resilient monolithic latch 3 comprises a first beam 13 and a second beam 14 connected by a connection element 15.

The first beam 13 comprises a force application structure or button 16, a first locking structure 17 and protrusions 18 provided between the connection element 15 and the locking structure 17. The locking structure 17 is shaped as a locking hook extending in a direction away from the second beam 14.

The second beam 14 does not comprise a force application structure, but only has a second locking structure 19 provided as a locking hook extending in a direction away from the first beam 13. The second beam also has protrusions 20 provided between the connection element 15 and the locking structure 19.

The connector housing 2 has an opening 21 capable of exposing the button 16 of the latch 3 to enable operation of the latch 3 as will be discussed in further detail with reference to FIGS. 5A and 5B. The connector housing 2 further has openings 22 to expose a portion of the first beam 13 and second beam 14 of the latch 3, in particular the first locking structure 17 and second locking structure 19.

Figure 4:
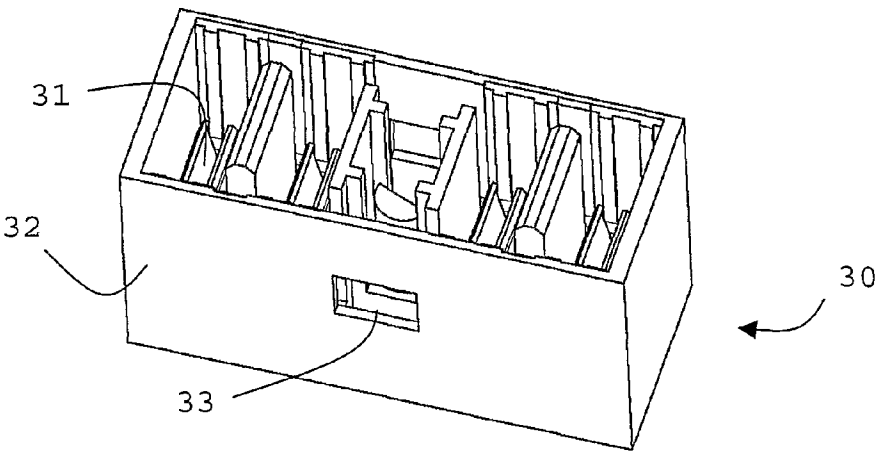
FIG. 4 illustrates a board connector as an example of a counterpart for the cable connector of FIG. 1A.
Figure 7:
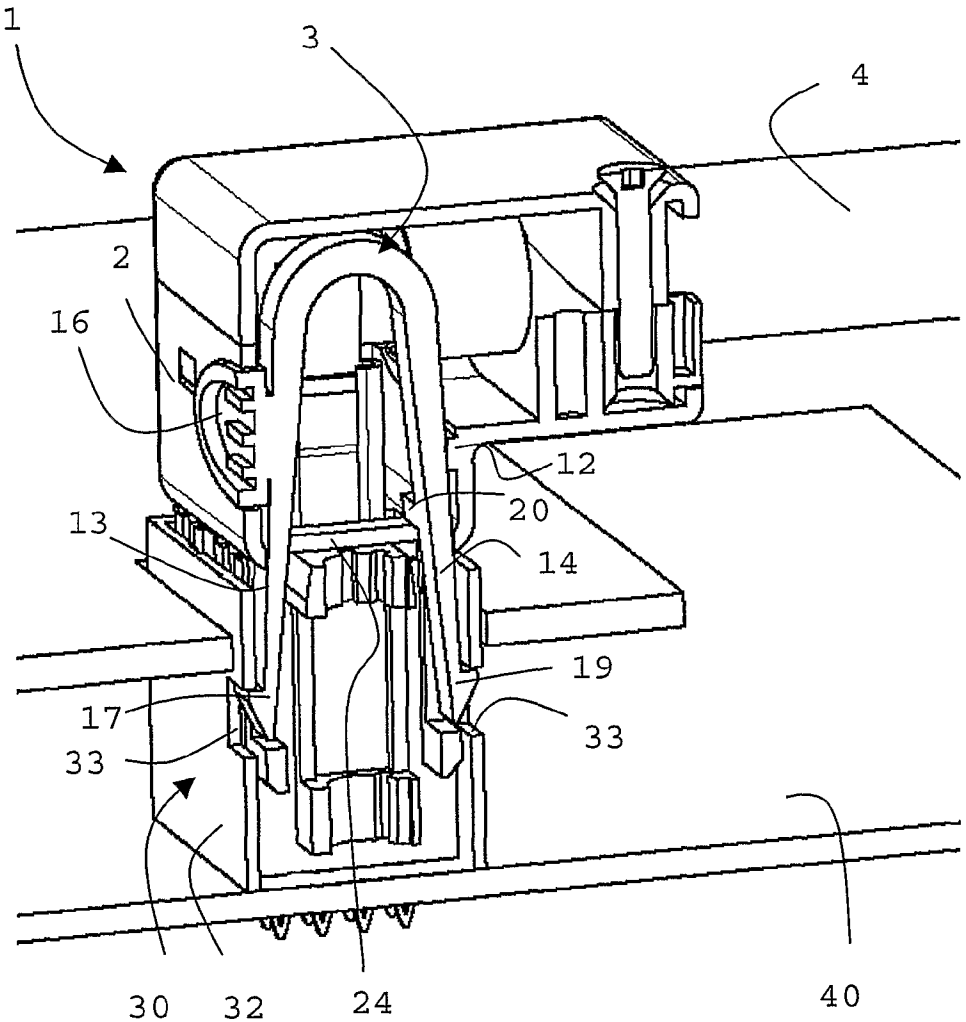
FIG. 7 shows the cable connector of FIG. 1A locked onto the board connector of FIG. 4.

The cable connector 2 of FIGS. 1A and 1B may be latched on a counterpart, such as a board connector 30 shown in FIG. 4 and FIG. 7. The board connector 30 has a plurality of contacts 31 capable of establishing an electrical connection with the contacts 6 of the cable connector 1 and accommodated in a board connector housing 32. The board connector housing 32 has openings 33 capable of receiving the locking structures 17, 19 of the latch 3 to accomplish a locked position as shown in FIG. 7.

The operation of the cable connector 1 according to an embodiment of the invention will be described next with reference to FIGS. 5A, 5B, 6, 7 and 8.

Figure 5B:
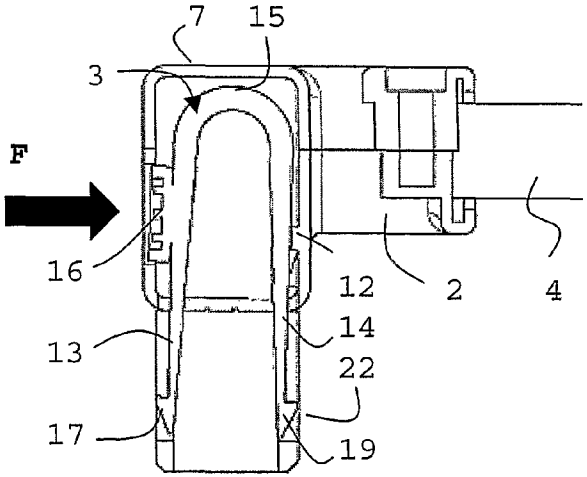
FIGS. 5A and 5B are cross-sectional views of the latch of FIG. 3 in an housing of the cable connector of FIG. 1 in operation of an embodiment of the invention.
Figure 5A:
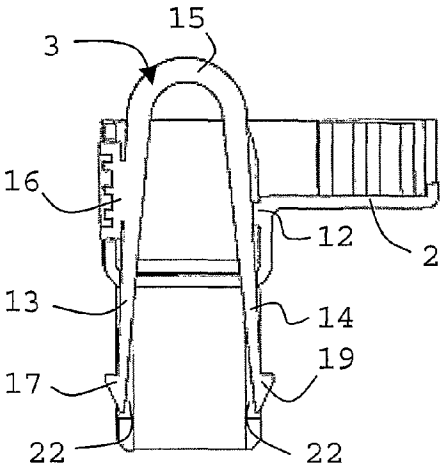

In FIG. 5A and 5B, a portion of the cable connector 1 is shown. In FIG. 5A, the resilient latch 3 is shown in its rest position in which case the locking structures 17, 19 of the latch 3 protrude through the openings 22 of the connector housing 2 allowing the cable connector 1 to be locked on the board connector 30 (shown in FIG. 7) by interaction between the locking structures 17, 19 of the latch 3 and the corresponding openings 33 of the board connector housing 32.

If a user desires to release the cable connector 1 from the board connector 30, he may manually presses (indicated as a force F) the button 16 provided on the first beam 13 of the latch 3 that is exposed through the opening 21 of the cable connector housing 2. The second beam 14 of the latch 3 and the connector housing 2 are arranged to interact with each other by providing the ridge 12 to move the second locking structure 19 from the locking position of FIG. 5A to a release position shown in FIG. 5B. Since the button 16 is applied on the first beam, also the first locking structure 17 is operated and moved from the locking position of FIG. 5A to the release position of FIG. 5B.

More specifically, the application of a force F on the button 16 and the relative positions of the button 16 and the ridge 12 with respect to each other trigger movement of the latch 3, in particular the top of the latch 3 at the connection element 15, in the cable connector housing 2 such that the second locking structure 19 of the latch 3 is retracted into the cable connector housing 2. In the embodiment shown in FIGS. 5A and 5B, the application of the force F on the button 16 initiates a small rotation of the latch 3 within the cable connector housing 2 around the ridge 12 to initiate movement of the second locking structure 19 of the second beam 14 in the appropriate direction. Simultaneously, the first beam 13 is pressed inwardly to unlock the first locking structure 17 as well.

Figure 6:
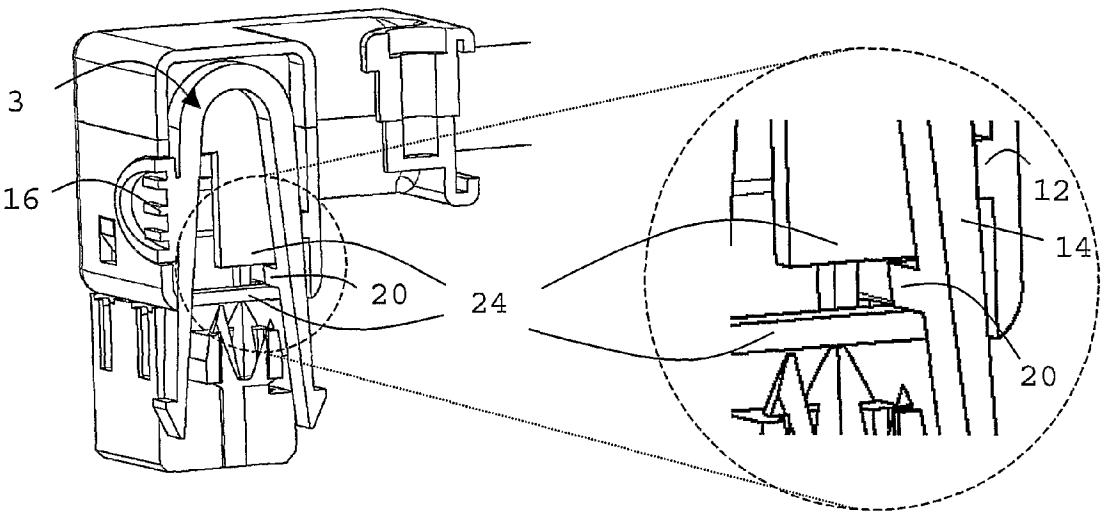
FIG. 6 illustrates a perspective view of a portion of the cable connector of FIG. 1A including an enlarged view of a portion of the connector.

In order to control the movement and (elastic) deformation of the latch 3 within the connector housing 2, the connector housing 2 comprises guiding structures 24 as most clearly illustrated in FIG. 6. The guiding structures 24 are arranged for guiding the protrusions 18, 20 of the latch 3 on application of the force F on the button 16.

Further control of the movement may be accomplished by providing a stop (not shown) that limits movement of the first beam 13 on application of a force F. Such a stop may prevent permanent deformation of the latch 3 if the force F exceeds a certain value. In practice, forces F may be in the range of 5-50 Newtons, such as 10, 20 or 30 Newtons.

FIG. 7 shows an illustration of a system according to an embodiment of the invention comprising a cable connector 1 connected to an locked onto a board connector 30, connected to a printed circuit board 40, by the above-described latch 3. The cable connector 1 can be released from the board connector 30 by applying a force F on the button 16 which results in movement, more specifically retraction, of the first locking structure 17 and second locking structure 19 back into the connector housing 2 as described with reference to FIGS. 5A and 5B. Clearly, in the situation of FIG. 7 there is no space at the side of the second beam 14 for providing and handling a further button to manipulate this beam, since the cables 4 accommodate this space.

Figure 8:
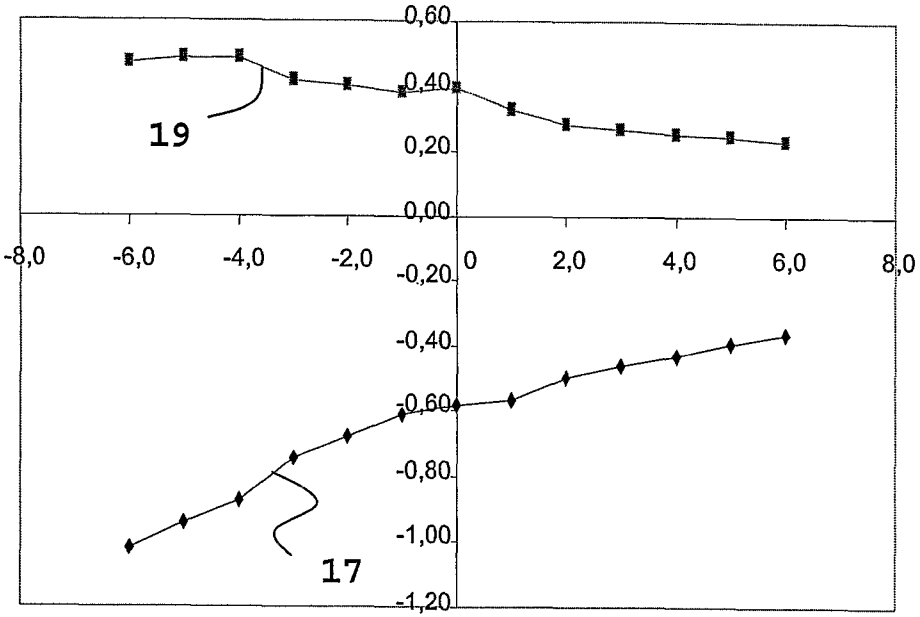
FIG. 8 depicts a characteristic illustrating behavior of the latch.

FIG. 8 shows a characteristic for the latch 3 when a force F of 10 Newtons is applied on the force application member 16 provided on the first beam 30. Along the horizontal axis, the distance in millimetres between the point of application of the force F on the button 16 and the ridge 12 is displayed. Positive values indicate that the ridge 12 is located above, i.e. closer to the connection element 15, the point of application of the force F on the button 16, whereas negative values indicate that the ridge 12 is located beneath, i.e. farther away from the connection element 15, the point of application of the force F. Along the vertical axis, the distance in millimetres for displacement of the first and second locking structures 17,19 is displayed. Clearly, the displacement curve of the first locking structure 17 (lower curve) yields higher absolute displacement values than the displacement curve of the second locking structure (19), since the first locking structure 17 is part of the first beam 13 on which the force application element 16 is applied. Furthermore, it can be observed that the relative positions of the ridge 12 and the point of application of the force F have influence on the displacement of the first and second locking structures 17, 19, although a locking structure displacement is achieved for all relative distances. Clearly, the displacement is largest when the ridge 12 is far below (here 6 mm) the point of application of the force F.

Figure 10:
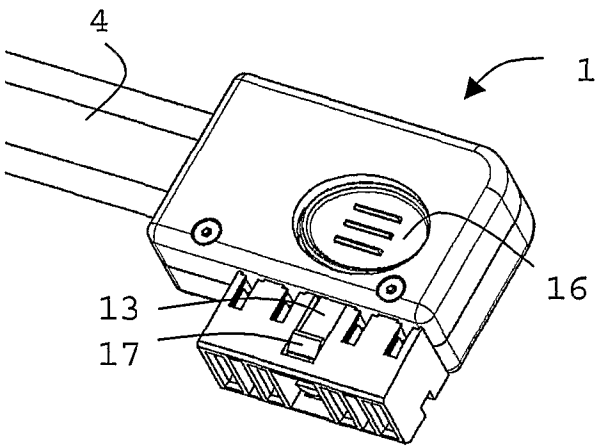
FIG. 10 shows a perspective view of the cable connector of FIGS. 9A and 9B.

It should be clear that the basic concept of the invention is that by operating only one button 16 of the latch 3, both locking structures 17, 19 can be displaced. However, this does not necessarily mean that the latch 3 should only have a single button 16, as will be shown with reference to FIGS. 9A, 9B and 10.

Figure 9B:
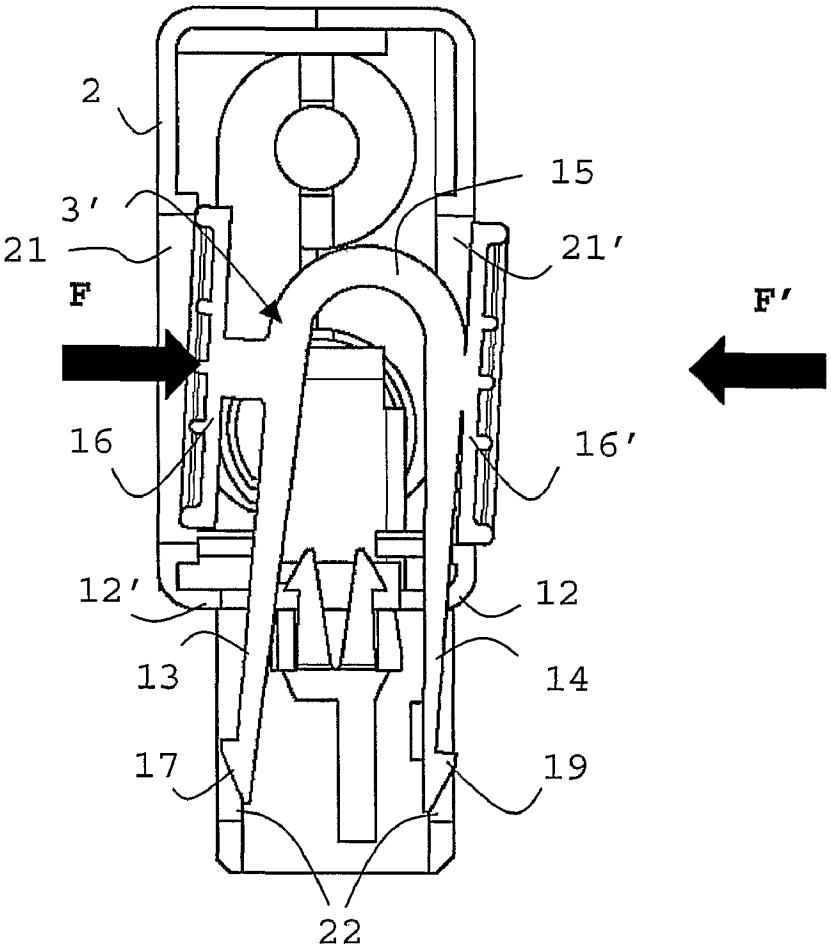
FIGS. 9A and 9B are cross-sectional views of a latch of in a housing of a cable connector according to a further embodiment of the invention.
Figure 9A:
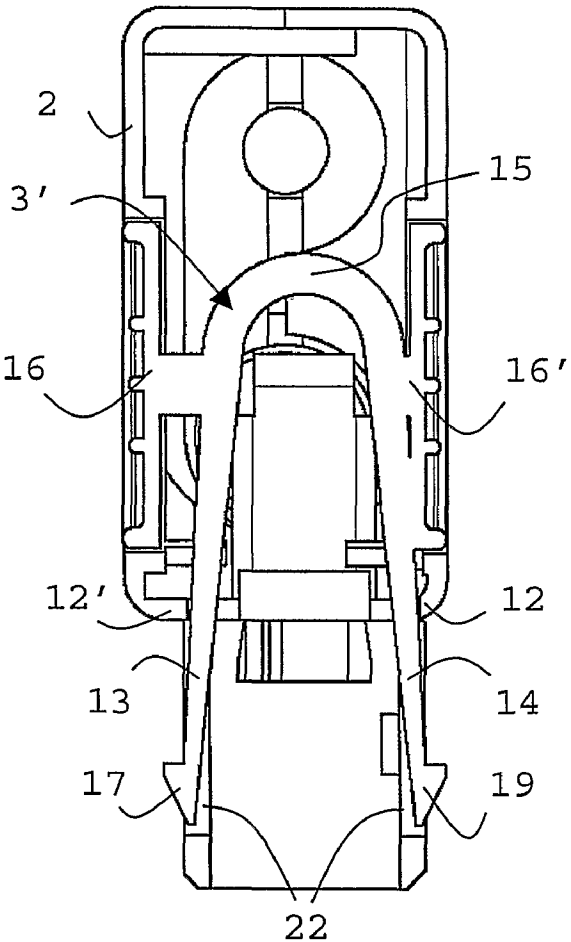

The latch 3' in FIGS. 9A and 9B has a further force application element 16' in addition to the force application element 16 described previously. The button 16' is exposed through an opening 21' of the housing 2 of the cable connector 1. Furthermore, the housing 2 comprises a first interaction structure 12 and a second interaction structure 12'. These interaction structures 12, 12' are formed by edges of the housing 2 in the present embodiment.

Again, on application of a force F on the button 16, the locking structures 17, 19 of the latch 3' are both displaced as discussed with reference to FIGS. 5A and 5B. However, a displacement of the locking structures 17, 19 may also be accomplished by applying a force F' on the further button 16'. Accordingly, the locking structures 17, 19 can both be displaced by operating either button 16 or button 16'. Such a cable connector may be used to advantage if e.g. little handling space is available as a result of several connectors being in close proximity to each other or insufficient space is available to operate both buttons.

The invention claimed is:

1. A connector comprising a connector housing and a latch comprising a first beam and a second beam, which first and second beam are connected with each other, said first beam comprising a first locking structure and said second beam comprising a second locking structure capable of locking said connector onto a counterpart in a locking position of said first and second locking structure, wherein said first beam comprises a force application element and said second beam and/or said first beam and said connector housing are arranged to interact with each other in order to move said second locking structure from said locking position to a release position on application of a force (F) on said force application element.

2. The connector according to claim 1, wherein said second beam comprises a further force application element and said first beam and said connector housing are arranged to interact with each other in order to move said first locking structure from said locking position to a release position on application of a force (F') on said force application element.

3. The connector according to claim 1, wherein said first beam and/or said second beam and/or said connector housing comprise an interaction structure for said interaction between said first beam respectively said second beam and said connector housing and said force application element is positioned relative to said interaction element such that said latch is capable of rotating around said interaction structure on application of said force (F, F').

4. The connector according to claim 1, wherein said latch comprises a first resilient beam and a second resilient beam connected by a connection element and wherein said first resilient beam comprises a first locking hook extending in a direction away from said second resilient beam and said second resilient beam comprises a second locking hook extending in a direction away from said first resilient beam.

5. The connector according to claim 1, wherein said latch comprises one or more protrusions and said housing comprises guiding structures arranged for guiding said protrusions of said latch on application of said force (F).

6. The connector according to claim 1, wherein said connector housing comprises an opening exposing said force application element of said first beam and/or said second beam.

7. The connector according to claim 1, wherein said connector comprises one or more openings for receiving one or more cables and one or more contacts oriented in an insertion direction and capable of establishing contact with corresponding contacts of said counterpart and wherein an axial direction of said openings is substantially perpendicular to said insertion direction of said contacts.

8. A cable connector comprising a connector housing and a latch comprising a first beam and a second beam, which first and second beam are connected with each other via a connection element, said first beam comprising a first locking hook and said second beam comprising a second locking hook capable of locking said connector onto a counterpart in a locking position of said first and second locking hook, wherein said first locking hook and said second locking hook extend in a direction away from each other and wherein said first beam comprises a force application element and said connector housing comprises a ridge such that, on, application of a force (F) on said force application element, said latch rotates around said ridge by interaction with said second beam or said first beam and said second locking hook moves from said locking position to a release position.

9. A method for releasing a cable connector from a board connector, said cable connector comprising a connector housing and a latch comprising a first beam and a second beam, which first and second beam are connected with each other, said first beam comprising a first locking structure and said second beam comprising a second locking structure capable of locking said connector onto said board connector in a locking position of said first and second locking structure, wherein said first beam comprises a force application element and said second beam and said housing are arranged to interact with each other in order to move said second locking structure, said method comprising the step of applying a force (F) on only said force application element of said first beam to release said first and second locking structure from said board connector.

10. A connector comprising a connector housing and a latch comprising a first beam and a second beam, which first and second beam are connected with each other, said first beam comprising a first locking structure and said second beam comprising a second locking structure capable of locking said connector onto a counterpart in a locking position of said first and second locking structure, wherein said first beam is operable and said second beam and/or said first beam and said connector housing are arranged to interact with each other in order to move said second locking structure from said locking position to a release position on application of a force (F) on said operable first beam.

11. A connector comprising:

a connector housing; and a latch comprising a first beam and a second beam, wherein said first and second beams are connected with each other, said first beam comprising a first locking structure and said second beam comprising a second locking structure capable of locking said connector onto a counterpart in a locking position of said first and second locking structure, wherein said first beam comprises a first section adapted to be deflected in an inward direction on application of a force on said first section to thereby move said first locking structure from said locking position to a release position, and wherein said second beam and/or said first beam, and said connector housing are arranged to interact with one another when said first section is deflected in the inward direction in order to move said second locking structure from said locking position to a release position.

* * * * *